United States Patent [19]

Humphreys

[11] 3,949,340

[45] Apr. 6, 1976

[54] FUSE CONSTRUCTION

[75] Inventor: Robert B. Humphreys, Kettering, Ohio

[73] Assignee: Micro Devices Corporation, Dayton, Ohio

[22] Filed: May 22, 1970

[21] Appl. No.: 39,710

[52] U.S. Cl. ..... 337/159; 337/162; 337/232; 337/276; 337/290; 337/295

[51] Int. Cl.[2] ..... H01H 85/04

[58] Field of Search ..... 337/158, 159, 160, 161, 337/162, 232, 276, 290, 295, 297, 416; 317/261; 174/110 A

[56] References Cited

UNITED STATES PATENTS

| | | | |
|---|---|---|---|
| 2,914,636 | 11/1959 | Kozacka | 337/158 X |
| 2,961,593 | 11/1960 | Kozacka | 337/159 |
| 2,968,752 | 1/1961 | Rubinstein et al. | 317/261 X |
| 3,530,505 | 9/1970 | Salzer | 337/159 |

*Primary Examiner*—R. N. Envall, Jr.
*Assistant Examiner*—Fred E. Bell
*Attorney, Agent, or Firm*—Candor, Candor & Tassone

[57] ABSTRACT

A fuse construction has two spaced electrical conductors with inwardly directed conductor ends. A fuse plate member has opposite plate edges secured to said conductor ends. Said fuse plate has an inner insulative sheet with opposite outer conductive sheet faces. One of the sheet faces has an electric current breaking open band adjacent one conductor and the other sheet face has a similar band adjacent the other conductor. A fusible pin passes through a central part of said insulative sheet and said conductive faces and has its pin ends secured to said conductive faces between said open bands so that said bands do not break the electric current passing between said conductors while the pin does not blow but do break said electric current when the pin blows. A method of assembly of said fuse construction is disclosed.

10 Claims, 7 Drawing Figures

INVENTOR.
ROBERT B. HUMPHREYS

BY

Cando, Candeo Tarone

HIS ATTORNEYS

INVENTOR.
ROBERT B. HUMPHREYS

BY
Cauder, Cauder & Vanore

HIS ATTORNEYS

FUSE CONSTRUCTION

SUMMARY OF THE INVENTION

A feature of this invention includes a fuse construction in which two spaced electrical conductors or connectors are provided with inwardly directed conductor or connector ends. A fuse plate member is provided with opposite plate edges secured to said conductor ends.

Said fuse plate is provided with an insulative sheet to which opposite metal outer conductive sheet faces are adhered or secured.

One of the conductive sheet faces is provided with an electric current breaking open band adjacent one of the said conductors or connectors. The other of said conductive faces has another electric current breaking band adjacent the other conductor or connector.

A fuse pin passes through a central part of the insulative sheet and through a central part of both said conductive sheets and between said current breaking bands. The ends of said fuse pin are secured, brazed or soldered to the conductive sheets.

The fuse construction is such that said current breaking open bands cannot break the electric current passing between said conductors or connectors while the fuse pin does not blow. However, such open bands do break said electric current when the fuse pin blows in response to an overload or the like.

Another feature of this invention includes a fuse plate construction in which one metal conductive sheet face has a major metal conductive sheet portion adjacent one of the electrical conductors and the other metal sheet face has a major metal conductive sheet portion adjacent the other electrical conductor. Minor metal sheet portions are provided on each face of the fuse plate longitudinally spaced from respective said major metal sheet portions to produce said current breaking open bands. Such major and minor metal conductive portions are longitudinally offset with respect to each other along the longitudinal axis of the fuse construction to provide a relatively rigid bending resistance for the entire insulative sheet. This also permits superior soldering of the fuse plate to the electrical conductors.

Other features of this invention are apparent from this description, the appended claims, and/or the accompanying drawings, in which:

Figure 1:
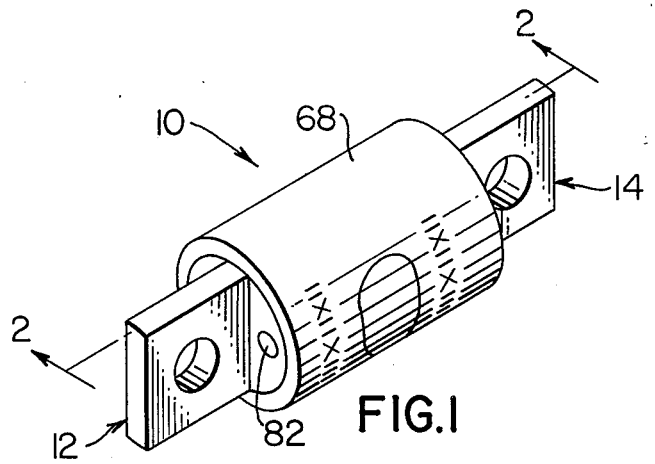
FIG. 1 is a perspective view of the now preferred assembled fuse construction according to this invention.

A fuse construction 10, according to this invention, may include two opposed, spaced, electrical conductors or connectors 12 and 14. These connectors may be provided with opposite, inwardly directed, conductor ends 16 and 18.

A fuse plate 20 may have opposite plate edges 22 and 24 secured to said conductor ends 16 and 18.

Said fuse plate 20 may have an inner insulative sheet 26 with opposite outer metal conductive sheet faces 28 and 30 secured or adhered to said sheet 26.

One of the conductive sheet faces 28 may have an electric current breaking open band 32 adjacent one of the said conductors 12. The other of said conductive sheet faces 30 may have another electric current breaking band 34 adjacent the other conductor 14.

A fusible fuse pin 36 may pass through a central part or opening 38 in said insulative sheet 26 and in said sheet faces 28 and 30 and may have its ends pass through and be secured, brazed, or soldered to said conductive sheet faces 28 and 30, as indicated at 42.

The construction is such that the current breaking open bands 32, 34 cannot break the electric current passing between said conductors while said fuse pin 36 does not blow. However, said open bands 32, 34 do break said electric current when said fuse pin 36 blows.

The inwardly directed conductor ends 16 and 18 may be inward flat conductor ends and have flat surfaces 44 and 46 to which the plate edges 22 and 24 are secured. These flat conductor ends may have grooves 48 and 50 which receive the fuse plate edges 22 and 24. Such plate edges 22 and 24 may be secured or soldered at 52, 54 to the flat ends or surfaces 44 and 46.

The flat conductor ends 16 and 18 may be cylindrical conductor ends, and a cylindrical insulative sleeve 56 may be telescoped over such ends 16 and 18. The ends 58, 60 of the sleeve 56 may be secured to the conductor ends 16 and 18 by any suitable means, such as by radially directed knurled pins 62 passing through suitable openings 64 in the sleeve 56 and in conductor ends 16 and 18.

A thin outer cover 68 may be wrapped around the insulative sleeve 56 and may be secured thereto in any desired manner, such as by being adhesively adhered thereto. Such cover 68 may be provided with an attractive outer surface which may carry any desired information, such as model number, trade mark, ampere capacity, etc.

The conductors 12 and 14 may have connector extensions 70, 72 with connector openings 74, 76 for attachment of power lines. The extensions 70, 72 may be formed in any suitable manner, such as by grinding off or otherwise forming such extensions 70, 72 from two original cylindrical rods which also produce the cylindrical conductor ends 16 and 18. The openings 74, 76 may then be bored into the extensions 70, 72, and the parts so produced may be silver plated.

The cylindrical conductor ends 16 and 18 may have longitudinal openings 78 and 80 through which small particle insulative material, or comminuted insulative material, such as quartz sand, may be introduced to fill the space around the fuse plate 20 to provide a heat sinck for the plate 20 and to limit the arcing effect when the fuse pin blows. Suitable closing pins 82 and 84, which may be slightly tapered, are driven into the slightly tapered openings 78 and 80 after the sand has been inserted.

The finished conductors or connectors 12 and 14 actually may be identical before assembly, and are merely oppositely directed during assembly. This tends to reduce inventory costs.

The fuse construction 10 may be assembled by inserting the edge 22 of the fuse plate 20 into the groove 48 with a slight length of the conductive sheet faces in the groove 48, and then soldering the faces at 52, 52 along both sides of groove 48. Thereafter the edge 24 of the fuse plate 20 may be inserted into the groove 50 with a slight length of the conductive sheet faces in the groove 50 and then soldering them at 54, 54, while maintaining the cylindrical conductor ends 16 and 18 aligned. Then the insulative sleeve 56 may be telescoped over the connector ends 16 and 18 and may be fastened in place by driving in the pins 62 into the openings 64. Then the fuse construction may be held vertical and sand may be introduced into the upwardly directed opening 78 while temporarily closing opening 80 with an easily removable closure until filled as much as possible, after which plug 82 may be driven in place to close opening 78. Thereafter the fuse construction may be vertically held with opening 80 upward and uncovered. Then sand may be introduced in the opening 80 to complete the filling of sand. Then opening 80 may be closed by driving in plug 84. Thereafter, the ornamental cover 68 may be wrapped around and secured or adhered to the cylinder 56.

The fuse plate 20 has many desirable features and may be made in any desired manner.

Figure 6:
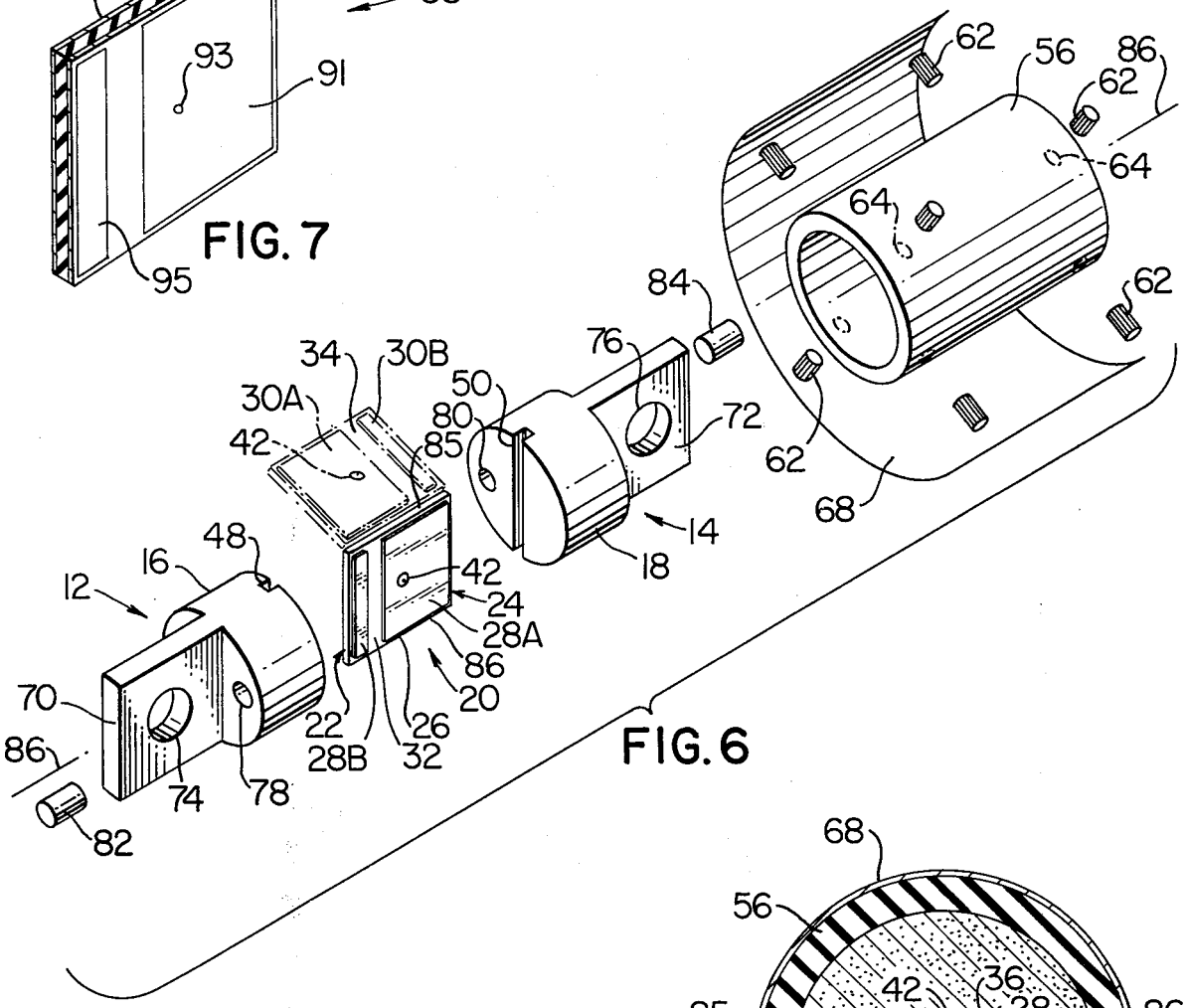
FIG. 6 is an exploded perspective view of the components to be assembled to produce the fuse construction shown in FIGS. 1–5, and including a dotted line showing of the other side of the fuse plate.

The inner insulative sheet 26 is partially covered on opposite sides by adhesively secured outer metal conductive sheet faces 28 and 30. Each of these sheet faces has respectively major conductive sheet portions 28A and 30A and minor sheet portions 28B and 30B, which are separated respectively by the current breaking bands 32 and 34. These bands are offset from each other along the longitudinal axis 86', FIG. 6. The fuse pin 36 passes through the major conductive sheet portions 28A and 30A. These major conductive sheet portions 28A, 30A also are offset with respect to each other along the longitudinal axis 86'. In view of this, these major metal conductive sheet portions 28A and 30A provide a relatively rigid bending resistance to both sides of the entire insulative sheet 26. These metal portions 28A, 30A may be soldered respectively at 52 and 54 to the conductor ends 16, 18, FIG. 3, on one side of the grooves 48, 50.

Figure 3:
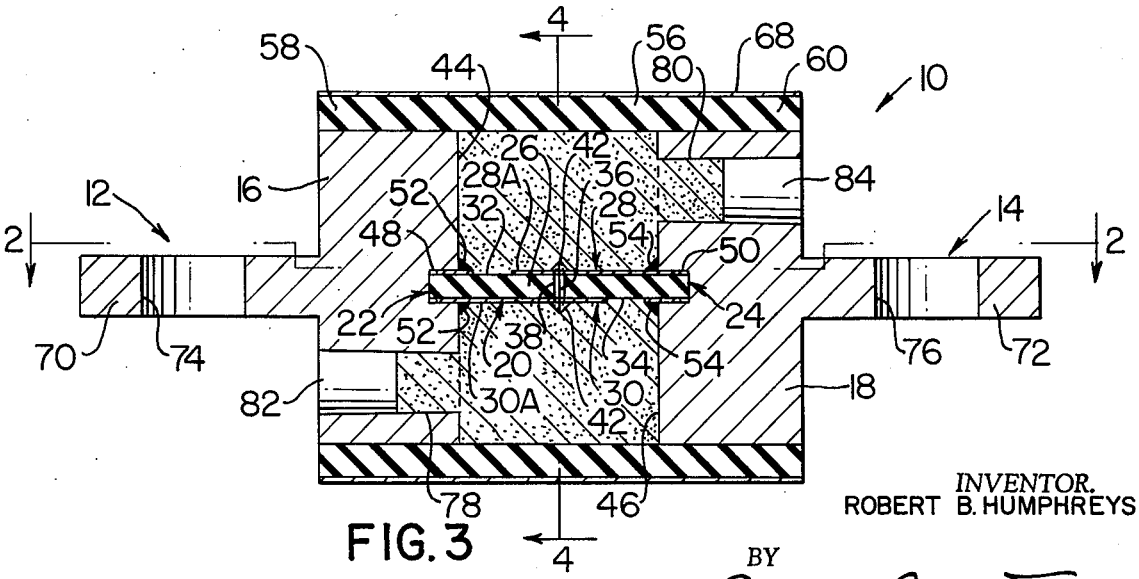
FIG. 3 is a cross section taken along the line 3—3 of FIG. 2.
Figure 7:
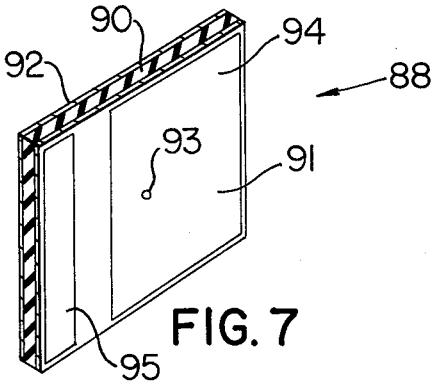
FIG. 7 is a perspective view of a laminated blank from which the fuse plate may be made, but not drawn to relative thickness scale.

The minor conductive metal sheet faces 28B, 30B provide metal surfaces which can also be soldered respectively at 52, 54 to the conductor ends 16, 18, FIG. 3, on the opposite sides of the grooves 48 and 50.

This construction provides a relatively rigid fuse plate 20 which is easily inserted into the grooves 48 and 50 and can be easily and conductively soldered, brazed, etc., to the conductor ends 16 and 18.

The fuse plate 20 thus provides effective conductivity between the conductors 12 and 14, limited substantially only by the slight resistance of the unblown fuse pin 36. The fuse plate also provides effective large nonconductive resistance areas at open bands 32 and 34 when the fuse pin 36 blows.

Figure 2:
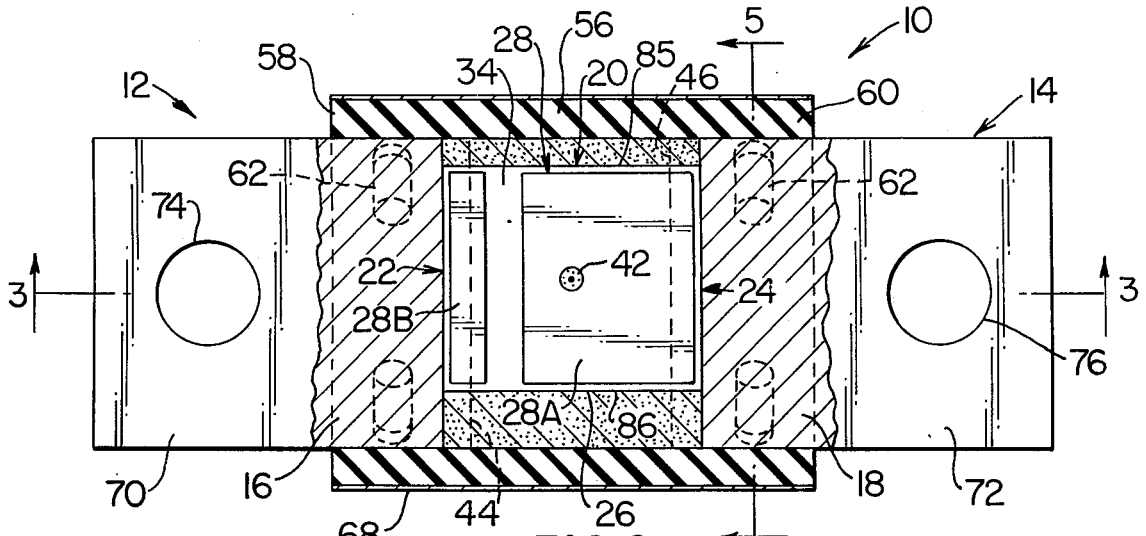
FIG. 2 is a cross section taken generally along the line 2—2 of FIGS. 1 and 3, with certain parts shown in elevation.
Figure 4:
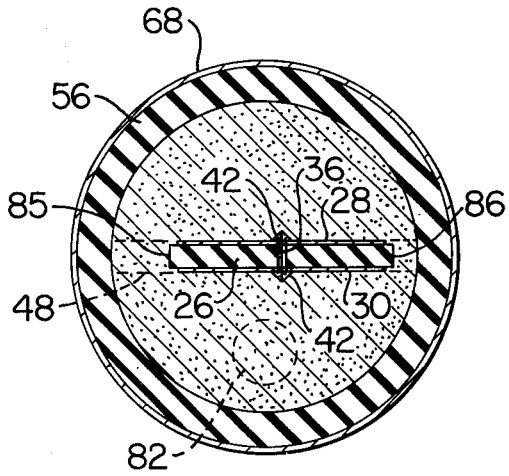
FIG. 4 is a cross section taken along the line 4—4 of FIG. 3.
Figure 5:
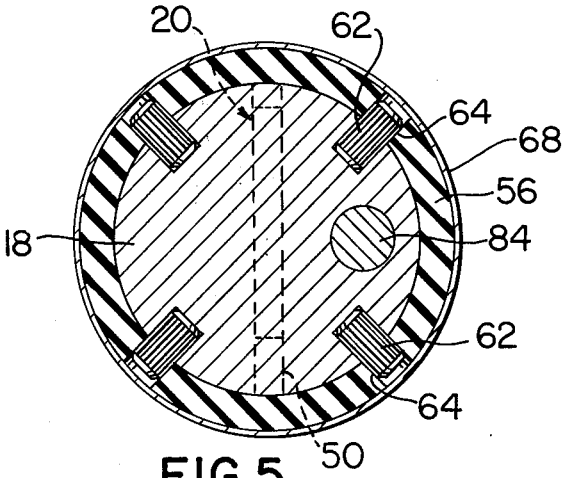
FIG. 5 is a cross section taken along the line 5—5 of FIG. 2.

An advantage of the fuse plate 20 is that such plate need not, but can, be centered along the longitudinal axis 86', 86' of the construction. Such plate may be placed slightly off center, as shown in FIGS. 2, 4 and 5. Alternatively, the plate may be centered. Alternatively, the plate may be substantially of the same width as the length of the grooves 48 and 50. In this last example, the plate 20 automatically may align the cylindrical ends 16 and 18 during assembly of the fuse construction.

It may be desirable to provide the inner insulative sheet 26 of fuse plate 20 with bare outer rims at end edges 22, 24, also at side edges 85 and 86, and bare surfaces at the bare current breaking open bands 32 and 34. At these bare rims and surfaces, the outer metal conductive sheet faces, 28 and 30, do not cover the insulative sheet 26.

The fuse plate 20 may be constructed in any desired manner.

For example, a preliminary laminated blank 88 may be made by any of the well known procedures. The blank 88 may be rectangular. It may include an insulative inner sheet 90 and outer conductive sheets 91, 92. The inner sheet 90 may be etching acid resistant, and the sheets 91, 92 may be metal, such as copper sheets, and may be etched by an etching acid treatment.

The metal sheets 91, 92 may be adhesively secured to the insulative sheet 90, in any desired manner, such as is well known in the printed circuit industry.

In such "printed circuit" industry, relatively large laminated sheets are made, each having a relatively thick insulative inner sheet and two opposite outer, relatively thin conductive metal sheets. The inner insulative sheet is substantially etching acid resistant, and the outer metal sheets may be etched by such acid.

A plate of a desired size is generally cut from such laminated sheets, in the printed circuit industry, and the desired circuits are "printed" on one or both sides of the plate by well known etching methods. Generally one or more photographic acid resistant protected images are made on the outer metal surfaces to prevent the later applied etching acid from acting on such acid resistant protected surfaces, but permitting the acid later to remove the unprotected surfaces from the insulative inner sheet, during the etching procedure. Thereafter the plate is submerged in a proper etching acid solution and etched in a well known manner.

Such etching procedures are well known, and laminated sheets of any desired relative thickness, and other characteristics, may be obtained from commercial suppliers for producing etching printed circuits or the like. Inner and outer sheets for such laminated blanks may be obtained to have any desired results.

It is therefore unnecessary to provide any detailed chemical formulas for any of such sheets to be used in producing the blank 88 of this application, as such sheets may be obtained on the open market.

The blank 88 may be cut from a larger sheet of the "printed circuit" type of desired thickness of sheets and having outer sheets 91 and 92 of copper or other metal and of any desired thickness. Such blank may have an inner insulative sheet 90 of desired thickness and etching acid resistance.

The blank 88 may be cut from such larger sheet by cutting the larger sheet into strips of the desired width and then cutting such strips into blanks of proper length to produce the blanks 88.

Alternatively, such larger laminated sheet may be punched to produce the blank 88 by a single punching action.

An opening 93 may be made through the blank 88 at any time, either before or after the blank has been cut or punched.

Then the desired etching acid resistant image may be placed on both sides or faces of the blank by the photographic process previously described, if desired. Such images may be within the rectangles 94 and 95 on one side, and similar rectangles on the other side of the blank, (as shown at 30A and 30B in FIG. 6) to protect the inner portions of the rectangles against the action of the etching acid and to allow etching to take place along the edges of the blank 88 in a manner to produce the complete fuse plate 20 previously described and including the current breaking open bands 32, 34, fuse pin construction, etc.

Merely by way of example, the following information is given. A fuse construction of 100 ampere capacity according to this invention, may be substantially 3.125 inches long. The cylinder 56 may be 1.56+inches long, 1.21+ outside diameter and one inch internal diameter, and of glass epoxy tubing. The fuse pin 36 may be made of fine silver, approximately three-sixteenths inches long and 0.013 inches outside diameter or other dimensions to produce the desired ampere capacity. The conductor 12 and 14 may be made of brass and may be silver plated, with the circular ends 16 and 18 being one inch in diameter. The extensions 70, 72 may be 1 inch wide and three-sixteenths inches thick. The fuse plate 20 may be square, such as ¾ inches longitudinal axis length and transverse width. The opening 38 may be one sixty-fourth inches diameter and may be at the center of the plate 20. The total maximum thickness of the plate 20 may be one-sixteenth inches. The copper sheet edges may be etched inwardly one thirty-second inches from the edges of the inner insulative sheet 26. The current breaking open bands 32 and 34 may be one-eighth inches wide with their outermost edges being three thirty-seconds inches from the edges of the insulative sheet 26.

The laminated blank 88 may be cut from a printed circuit sheet identified by printed circuit suppliers as "1/16 nominal G-10 Glass Epoxy Board with 3 ounce copper sheets on both sides."

The above sizes, materials, etc., are given by way of example, but it is to be understood that persons skilled in this art can readily determine required sizes, materials, etc., from the disclosures in this application.

It is thus to be seen that a new and useful fuse construction has been provided by this invention.

What is claimed is:

1. A construction comprising, two opposed, spaced electrical conductors with opposite, inwardly directed conductor ends, a rigid fuse plate member having opposite plate edges secured to said conductor ends, said fuse plate having an inner insulative sheet with opposite outer conductive sheet faces, said outer conductive sheet faces each having its peripheral edge inwardly spaced from the peripheral edge of said inner insulative sheet throughout the entire peripheral edge of said inner insulative sheet, one of said sheet faces having an electric current breaking open band adjacent one of said conductors and the other of said sheet faces having another electric current breaking open band adjacent the other of said conductors, a fuse pin passing through a center part of said insulative sheet with its fuse pin ends secured to said conductive faces between said open bands, so that said bands cannot break the electric current passing between said conductors while said fuse pin does not blow, and said bands break said electric current when said fuse pin blows, each said conductor ends having a groove therein defining a bottom wall of said groove and receiving an opposite plate edge in such a manner that only said insulative sheet engages said bottom wall of said groove because said conductive sheet faces at that plate edge are inwardly spaced from the peripheral edge of said insulative sheet, said open bands being respectively adjacent said conductor ends and slightly spaced therefrom so that conductive parts of said plate can be secured to each conductor end on both sides of said plate, said open bands being offset relative to each other and to said opposite plate edges so that opposite sides of said fuse plate are substantially identical to each other except that the same are turned approximately 180° relative to each other whereby each side of said plate has a major conductive sheet face portion extending from one conductor end almost to the other conductor end to provide a relatively rigid bending resistance to said plate.

2. A construction according to claim 1 in which said fuse wire has fuse wire ends passing outwardly through said conductive faces with said fuse wire ends being electrically connected to said conductive faces.

3. A construction according to claim 1 in which said electrical conductor ends are inward transversely flat conductor ends, to which said plate edges are secured.

4. A construction according to claim 3 in which said flat conductor ends are cylindrical conductor ends, and a cylindrical enclosing insulative sleeve has its ends surrounding and secured to said cylindrical conductor ends.

5. A construction according to claim 4 in which the ends of said insulative sleeve are secured to said cylindrical conductor ends by pins passing through said cylindrical sleeve and into said conductor ends.

6. A construction according to claim 5 in which a thin outer cover is wrapped around and secured to said insulative sleeve.

7. A construction according to claim 6 in which said cover is adhesively secured to said insulative sleeve.

8. A construction according to claim 3 in which said current breaking open bands are substantially rectangular open bands with one rectangular open band adjacent one of said flat conductor ends and with the other rectangular open band adjacent the other flat conductor end.

9. A construction according to claim 1 in which one of said conductors has a filling end opening through which small particle insulative material has been introduced adjacent said fuse plate and which filling end has been closed after said small particle material has been so introduced.

10. A construction according to claim 9 in which the other of said conductors has a similar filling end opening through which small particle insulative material has been introduced adjacent said fuse plate and which similar filling end opening has been similarly closed.

* * * * *